US010010189B2

(12) United States Patent
Eigenmann et al.

(10) Patent No.: US 10,010,189 B2
(45) **Date of Patent: *Jul. 3, 2018**

(54) POCKETED SPRING ASSEMBLY COMPRISING STRINGS OF SPRINGS OF DIFFERENT HEIGHTS AND ENHANCED VENTILATION

(71) Applicant: L&P Property Management Company, South Gate, CA (US)

(72) Inventors: Guido Eigenmann, Carthage, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 346 days.

This patent is subject to a terminal disclaimer.

(21) Appl. No.: 15/089,899

(22) Filed: Apr. 4, 2016

(65) Prior Publication Data

US 2016/0213159 A1 Jul. 28, 2016

Related U.S. Application Data

(63) Continuation of application No. 14/461,892, filed on Aug. 18, 2014, now Pat. No. 9,332,856.
(Continued)

(51) Int. Cl.
*A47C 27/06* (2006.01)
*A47C 23/043* (2006.01)
(Continued)

(52) U.S. Cl.
CPC ..... *A47C 27/064* (2013.01); *A47C 7/742* (2013.01); *A47C 7/746* (2013.01); *A47C 21/042* (2013.01); *A47C 23/043* (2013.01); *A47C 27/05* (2013.01)

(58) Field of Classification Search
CPC ..... A47C 23/00; A47C 23/043; A47C 23/002; A47C 23/04; A47C 23/0431; A47C 23/0438; A47C 27/04; A47C 27/064; A47C 27/06; A47C 27/063; A47C 27/065; A47C 27/07; A47C 7/742; A47C 21/042; A47C 27/05; A47C 7/746
See application file for complete search history.

(56) References Cited

U.S. PATENT DOCUMENTS 1,284,384 A 11/1918 Lewis
3,633,228 A 1/1972 Zysman
(Continued)

FOREIGN PATENT DOCUMENTS

KR 2003-0061737 7/2003
WO 2008/145185 12/2008
WO 2013/060983 5/2013

*Primary Examiner* — Eric J Kurilla
*Assistant Examiner* — Amanda Lee Bailey
(74) *Attorney, Agent, or Firm* — Wood, Herron & Evans, LLP

(57) ABSTRACT

A pocketed spring assembly comprises a plurality of parallel strings of individually pocketed springs of different heights. Each string is joined to an adjacent string. Each string has first and second opposed plies of fabric and a plurality of pockets formed along a length of the string by transverse seams joining the plies. An upper end of each transverse seam is below the upper surface of the string so as to partially separate adjacent pockets within a string of springs when the spring is relaxed. The strings of springs have ventilation openings to increase airflow.

20 Claims, 18 Drawing Sheets

Related U.S. Application Data

(60) Provisional application No. 62/013,290, filed on Jun. 17, 2014.

(51) Int. Cl.

| | |
|---|---|
| ***A47C 7/74*** | (2006.01) |
| ***A47C 21/04*** | (2006.01) |
| ***A47C 27/05*** | (2006.01) |

(56) References Cited

U.S. PATENT DOCUMENTS

| | | | |
|---|---|---|---|
| 4,485,506 | A | 12/1984 | Stumpf et al. |
| 4,523,344 | A | 6/1985 | Stumpf et al. |
| 4,895,352 | A | 1/1990 | Stumpf |
| 5,303,530 | A | 4/1994 | Rodgers |
| 5,319,815 | A | 6/1994 | Stumpf et al. |
| 5,467,489 | A | 11/1995 | Cchen |
| 5,868,383 | A | 2/1999 | Codos |
| 6,021,627 | A | 2/2000 | Mossbeck et al. |
| 6,122,900 | A | 9/2000 | Mossbeck et al. |
| 6,159,319 | A | 12/2000 | Mossbeck |
| 6,336,305 | B1 | 1/2002 | Graf et al. |
| 6,398,199 | B1 | 6/2002 | Barber |
| 6,408,514 | B1 | 6/2002 | Mossbeck et al. |
| 6,591,436 | B2 | 7/2003 | de Santis et al. |
| 6,668,406 | B2 | 12/2003 | Spinks et al. |
| 6,813,791 | B2 | 11/2004 | Mossbeck et al. |
| 6,826,796 | B1 | 12/2004 | Mossbeck |
| 6,829,798 | B2 | 12/2004 | Wells |
| 6,862,763 | B2 | 3/2005 | Mossbeck et al. |
| 6,986,182 | B2 | 1/2006 | Mossbeck |
| 7,048,263 | B2 | 5/2006 | Ahlqvist |
| 7,194,777 | B2 | 3/2007 | Edling et al. |
| 7,748,065 | B2 | 7/2010 | Edling |
| 7,908,693 | B2 | 3/2011 | DeMoss |
| 8,011,046 | B2 | 9/2011 | Stjerna |
| 8,307,523 | B2 | 11/2012 | Mossbeck et al. |
| 8,464,381 | B2 | 6/2013 | Mossbeck |
| 2004/0128773 | A1 | 7/2004 | Barber |
| 2007/0124865 | A1 | 6/2007 | Stjerna |
| 2007/0289068 | A1 | 12/2007 | Edling |
| 2010/0180385 | A1 | 7/2010 | Petrolati et al. |
| 2014/0033440 | A1 | 2/2014 | Tyree |

POCKETED SPRING ASSEMBLY COMPRISING STRINGS OF SPRINGS OF DIFFERENT HEIGHTS AND ENHANCED VENTILATION

CROSS-REFERENCE TO RELATED APPLICATIONS

This application is a continuation of U.S. patent application Ser. No. 14/461,892 filed Aug. 18, 2014 which claims the benefit of U.S. Provisional Patent Application Ser. No. 62/013,290 filed Jun. 17, 2014, each application of which is fully incorporated by reference herein.

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

More recently, improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs.

Once strings of pocketed springs are constructed, they may be assembled to form a spring core construction for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs serving as a complete spring core assembly.

Conventional pocketed spring cores incorporating pocketed strings of springs typically use springs of uniform diameter and pitch. U.S. Pat. No. 5,868,383 discloses a pocketed spring assembly incorporating springs which have different diameters and different pitches. An end portion of the pocketed spring may substantially compress before a middle portion compresses. The end portion may compress without the middle portion compressing when subject to lighter loads. However, due to the seams separating individual pockets extending the full height of the string of springs, the advantages of the coil springs may not be fully realized. The capability of the individually pocketed springs to act independently from the adjacent pocketed springs in the string of springs may be compromised.

Therefore, there remains a need to combine multiple technologies to improve the feel and motion transfer in a bedding or seating product having a pocketed spring core.

SUMMARY OF THE INVENTION

In one aspect, a bedding or seating product is provided. The product comprises a pocketed spring assembly comprising a plurality of parallel strings of springs, each string joined to an adjacent string. Each string comprises a plurality of individually pocketed springs. Each string comprises a piece of fabric comprising first and second opposed plies of fabric on opposite sides of the springs and joined together along a longitudinal seam. A plurality of pockets are formed along the length of the string by transverse or separating seams joining the first and second plies, and at least one spring being positioned in each pocket. A portion of the fabric of each of the strings of springs has a plurality of ventilation openings to increase airflow into and out of the string of springs resulting in a cooler product.

Each of the springs has upper and lower end turns and a plurality of central convolutions between the end turns. Each of the springs is preferably made of one piece of wire of a uniform diameter. An upper end of each transverse seam forming the adjacent pockets of the string is below an upper surface of the string of springs so as to partially separate the adjacent pockets when the springs are relaxed (not compressed). Cushioning materials may be placed on the pocketed spring assembly, and an upholstered covering may encase the pocketed spring assembly and cushioning materials.

The strings of springs can extend longitudinally or transversely. A bedding or seating product may be posturized into regions or zones of different firmness by incorporating different strings of springs into the product.

If the strings of springs extend transversely, the product can include a plurality of the strings having a "split top" feature in the seams between adjacent pockets and a plurality of the strings lacking the "split top" feature, the plurality of strings arranged in a plurality of zones longitudinally spaced apart. For example, the product can include three such zones. The three zones can comprise a central zone, a head end zone and a foot end zone. The end zones can have strings of springs having the "split top" feature, and the strings of springs comprising central zone can have strings of springs lacking the "split top" feature. Alternatively, the end zones can have strings of springs lacking the "split top" feature, and the strings of springs comprising central zone can have strings of springs with the "split top" feature.

If the strings of springs extend longitudinally, the product can include a plurality of the strings having the "split top" feature in the seams between adjacent pockets and a plurality of the strings lacking the "split top" feature, the plurality of strings arranged in a plurality of zones transversely spaced apart. For example, the product can include two such zones, a "his" side and a "hers" side. The "hers" side or zone can have strings of springs having the "split top" feature, and the "his" side or zone can comprise strings of springs lacking the "split top" feature. The reverse is possible as well.

In another aspect, a pocketed spring assembly for a bedding or seating product is provided. The pocketed spring assembly comprises a plurality of parallel strings of springs of different heights. Each string is joined to an adjacent string of springs. Each of the strings comprises a plurality of interconnected pockets. Each of the pockets contains at least one spring encased in fabric. The fabric is joined to itself along a longitudinal seam and has first and second opposed plies of fabric on opposite sides of the springs. The fabric of the first and second plies is joined by transverse seams. Each of the springs has upper and lower end turns and a plurality of central convolutions between the end turns. Each of the springs is preferably made of one piece of wire of a uniform diameter. Each of the transverse seams forming the adjacent pockets of the string has one end located below an upper surface of the string of springs so as to partially separate the adjacent pockets.

The strings of springs may extend longitudinally from side-to-side or transversely from end-to-end or head-to-foot. A portion of the fabric of at least some of the strings of springs may have ventilation openings to increase airflow. In one embodiment, some of the strings of springs are of a first height and other strings of springs are of a second height, one of the heights being greater than the other height.

In another aspect, a string of springs for a pocketed spring assembly for a bedding or seating product is provided. The pocketed spring assembly comprises a plurality of parallel strings of springs. Each string is joined to an adjacent string of springs. Each of the strings comprises a plurality of interconnected pockets. Each of the pockets contains at least one spring encased in fabric. The fabric has ventilation openings for increased airflow. The fabric is joined to itself along a longitudinal seam and has first and second opposed plies of fabric on opposite sides of the springs. The fabric of the first and second plies is joined by transverse seams. Each of the springs has two end portions and a middle portion between the end portions. Each of the springs is preferably made of one piece of wire of a uniform diameter. Each of the transverse seams forming the adjacent pockets of the string has an upper end located below an upper surface of the string of springs so as to partially separate the adjacent pockets and enable an upper end portion of the spring to compress without substantially compressing the middle portion of the spring.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
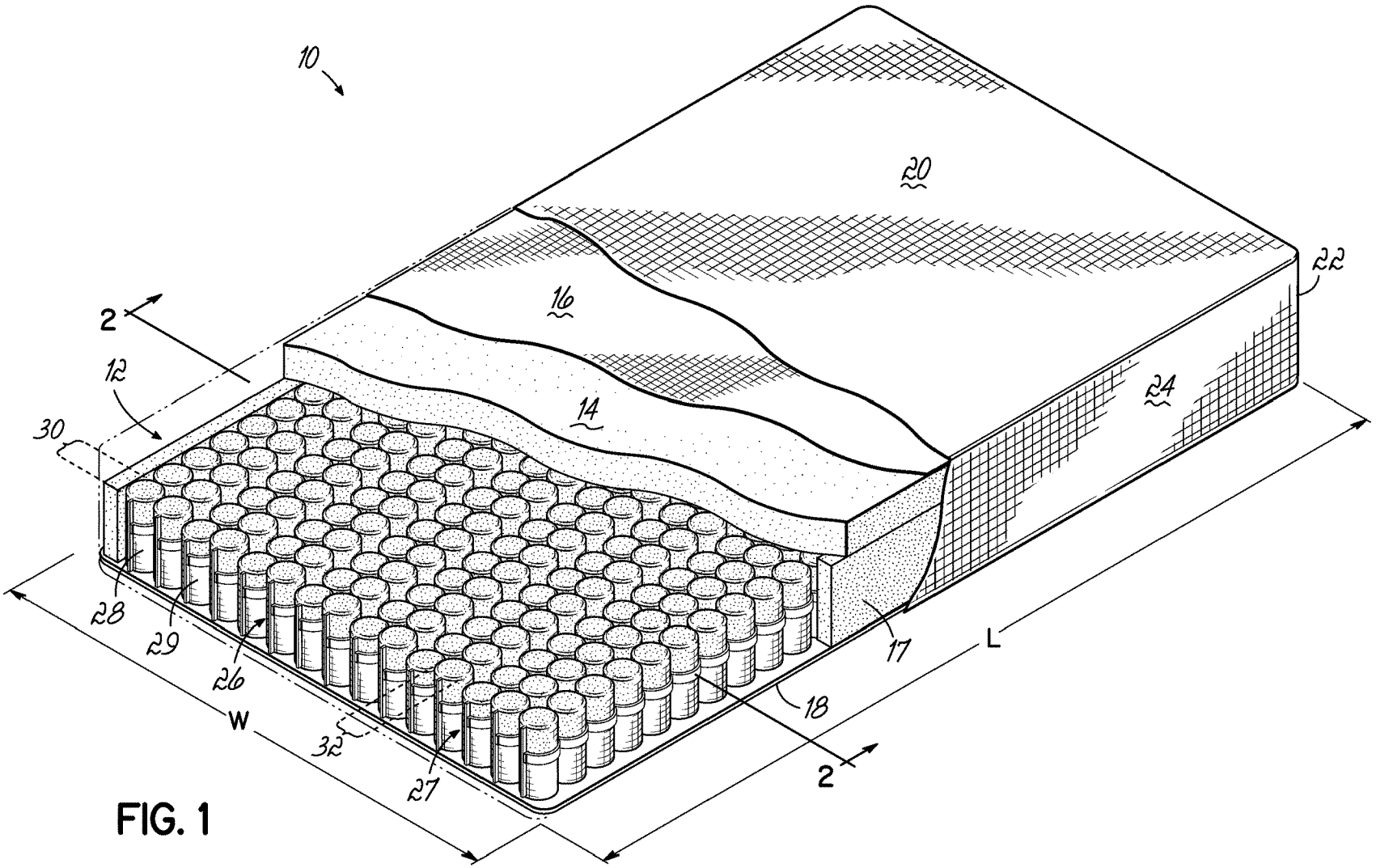
FIG. 1 is a perspective view, partially broken away, of a bedding or seating product incorporating a pocketed spring assembly according to the principles of the present invention.

Referring first to FIG. 1, there is illustrated a bedding product in the form of a single-sided mattress 10 incorporating the principles of the present invention. This product or mattress 10 comprises a pocketed spring assembly 12 over the top of which lays conventional padding or cushioning layers 14, 16 which may be foam, fiber, gel, a pocketed spring blanket or any other suitable materials or any combination thereof. The pocketed spring assembly 12 is surrounded with a border 17 made of foam or any other suitable material (only a portion being shown in FIG. 1). Although one type of border 17 is illustrated, the border may assume other forms or shapes of any desired size, such as pocketed coil springs. Alternatively, the border 17 may be omitted in this embodiment or any embodiment described or shown herein. This complete assembly is mounted upon a base 18 and is completely enclosed within an upholstered covering material 20. The base 18 and border 17 are known in the industry as a "bucket" into which a pocketed spring assembly 12 is inserted before the "bucket" is covered with one or more padding or cushioning layers. The base 18 may be foam, a scrim sheet, a piece of plastic, wood or any other known material.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

Figure 1A:
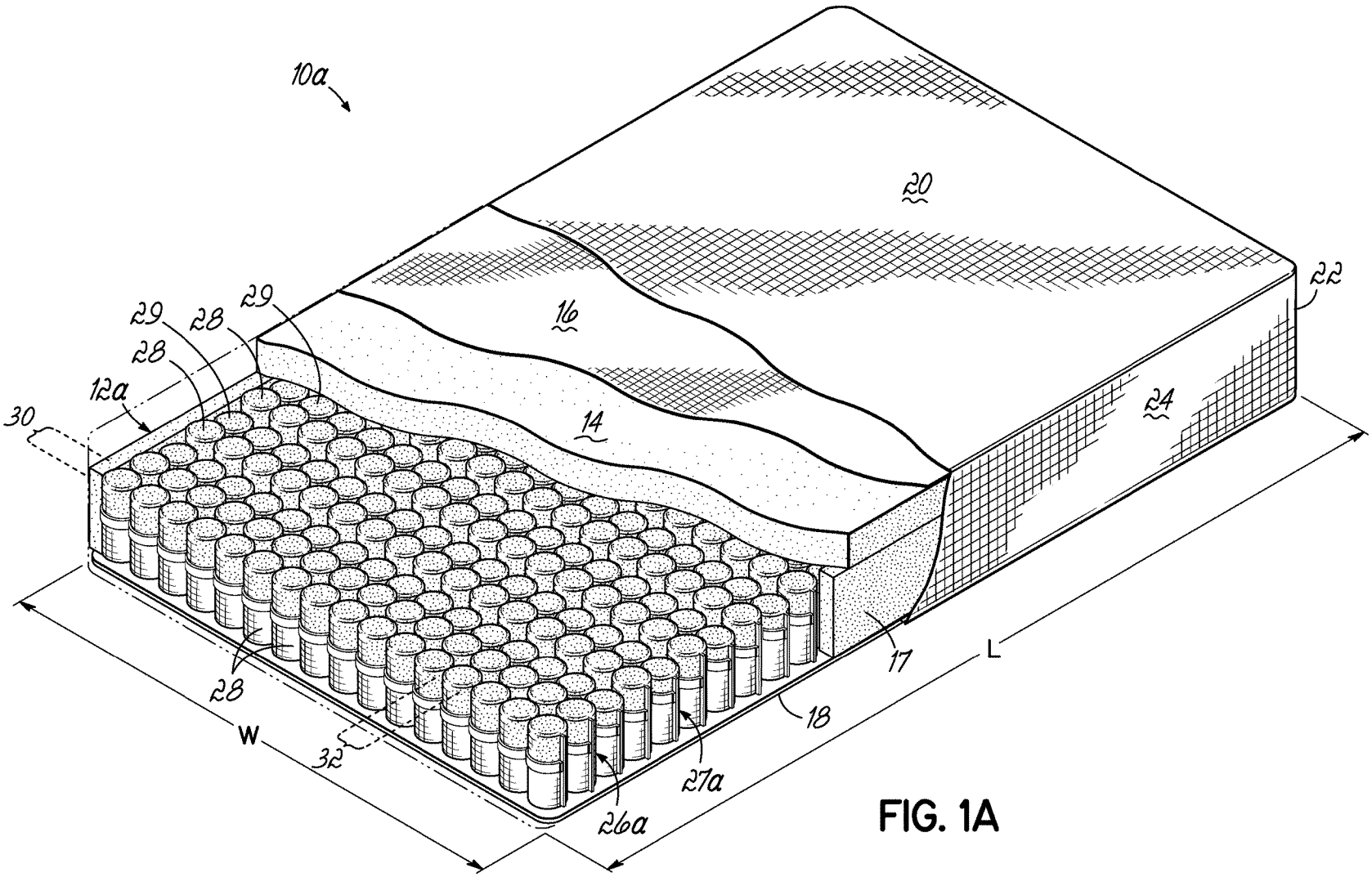
FIG. 1A is a perspective view, partially broken away, of a bedding or seating product incorporating another pocketed spring assembly.
Figure 2:
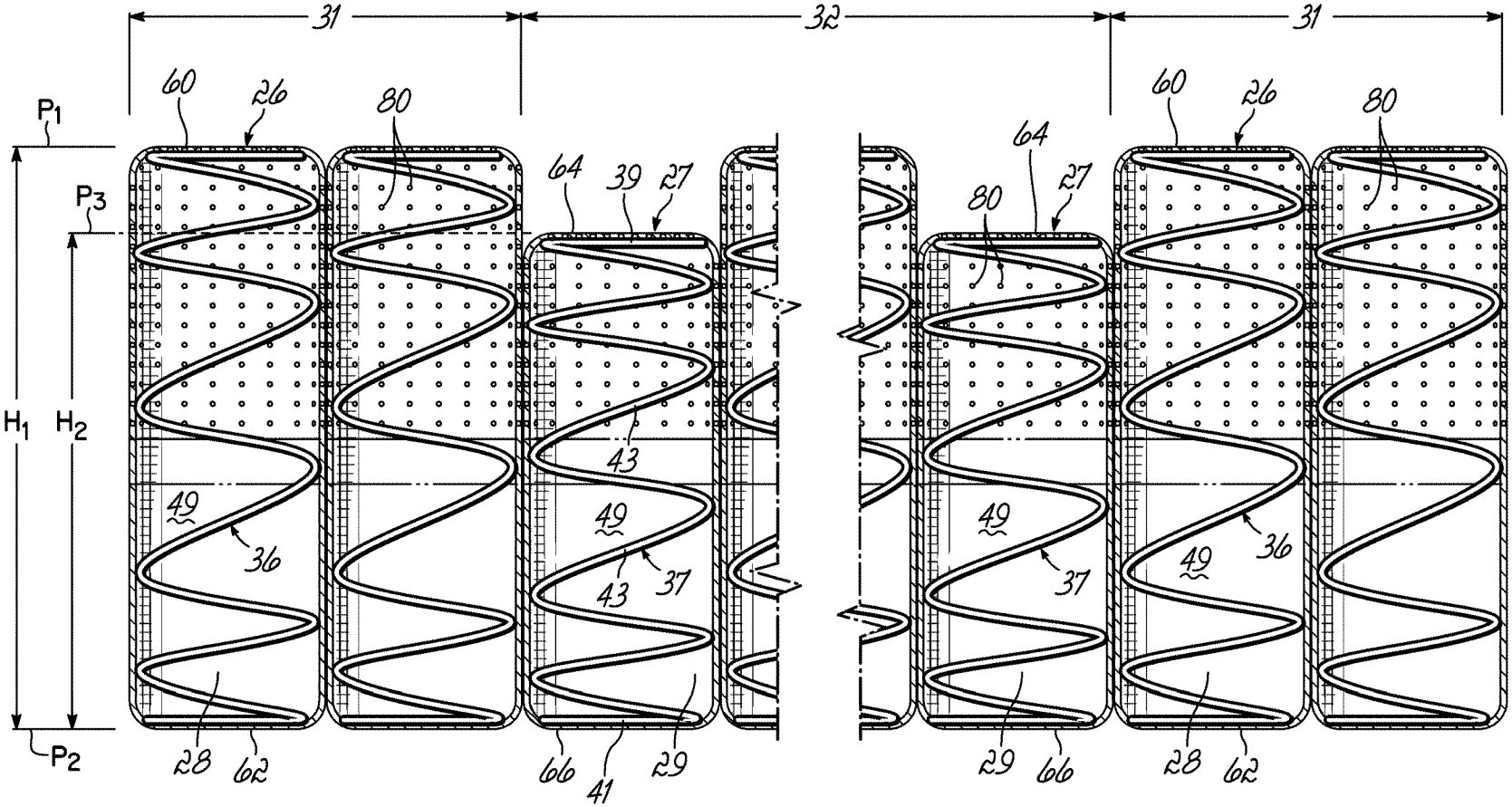
FIG. 2 is a cross-sectional view, partially broken away, taken along the line 2-2 of FIG. 1.

As shown in FIGS. 1 and 2, pocketed spring assembly 12 is manufactured from multiple strings 26, 27 of pocketed springs 28, 29 joined together. Each string of pocketed springs 26, 27 extends longitudinally or from head-to-foot along the full length of the product 10. Although the strings of pocketed springs 26, 27 are illustrated as extending longitudinally or from head-to-foot in the pocketed spring assembly 12 of FIG. 1, they may extend transversely or from side-to-side as shown in the pocketed spring assembly 12*a* shown in the product 10*a* shown in FIG. 1A. The pocketed spring assembly 12*a* comprises multiple strings 26*a*, 27*a* of pocketed springs, identical to the strings of springs 26, 27, but shorter in length. In any of the embodiments shown or described herein, the strings of springs may extend either longitudinally (from end-to-end) or transversely (from side-to-side).

Figure 1B:
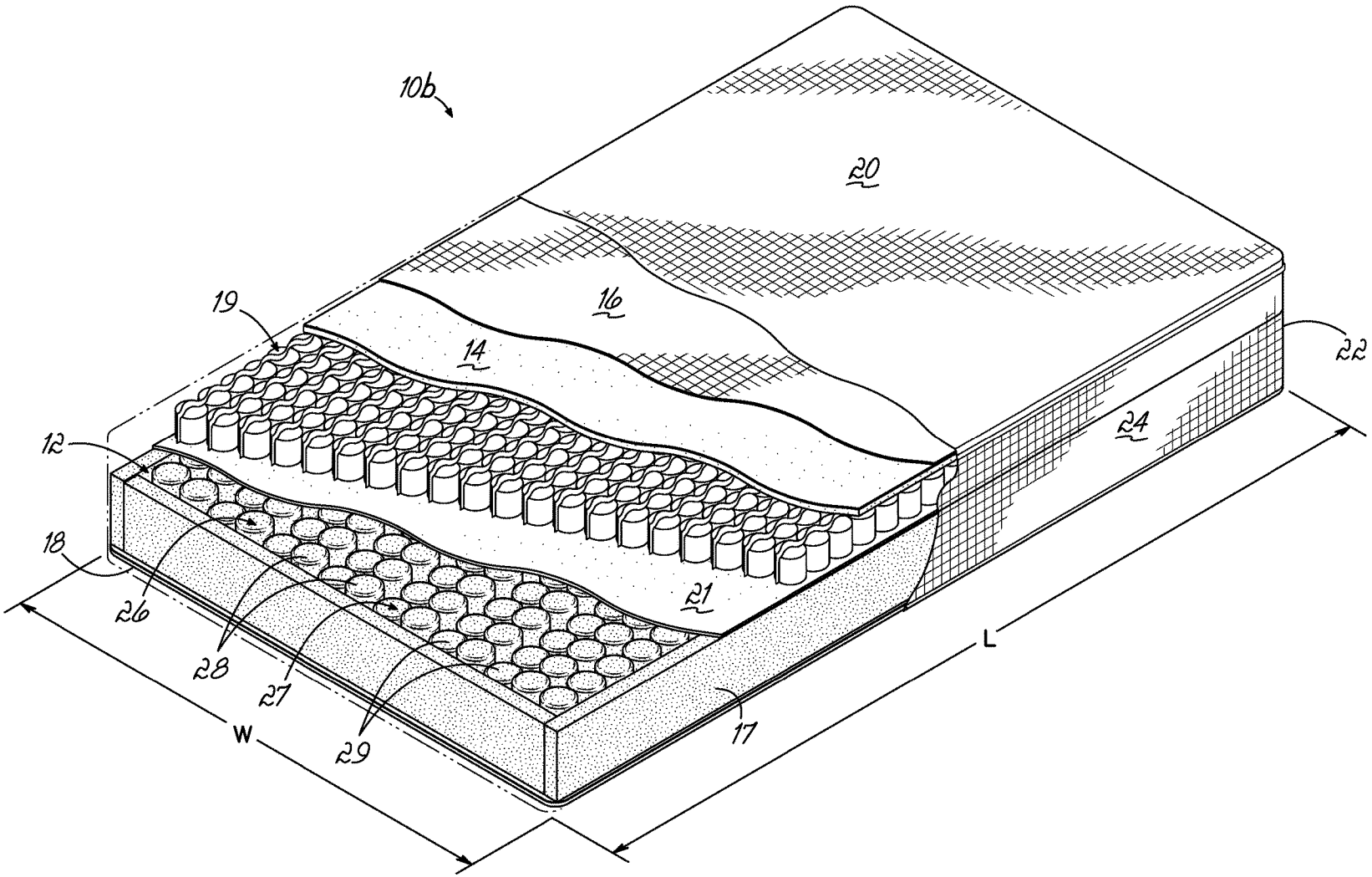
FIG. 1B is a perspective view, partially broken away, of another bedding product incorporating the pocketed spring assembly of FIG. 1.

FIG. 1B illustrates a single-sided mattress 10*b* comprising a pocketed spring assembly 12 and border 17 identical to those shown in the mattress 10 of FIG. 1. However, the mattress 10*b* of FIG. 1B has a pocketed topper 19 employing miniature or small strings of pocketed coil springs in addition to padding layers 14, 16 above the pocketed topper 19. A scrim layer 21 may separate the pocketed topper 19 from the pocketed spring assembly 12. Although one configuration of pocketed topper 19 is illustrated, any pocketed topper known in the art may be used.

If desired, any of the padding or cushioning layers, including the pocketed topper 19, may be omitted in any of the embodiments shown or described herein. The novel features reside in the pocketed spring assembly.

These strings of pocketed springs 26, 26*a*, 27 and 27*a*, and any other strings of springs described or shown herein, may be connected in side-by-side relationship as, for example, by gluing the sides of the strings together in an assembly machine, so as to create an assembly or matrix of springs having multiple rows and columns of pocketed springs bound together as by gluing, welding or any other conventional assembly process commonly used to create pocketed spring cores or assemblies.

Figure 6:
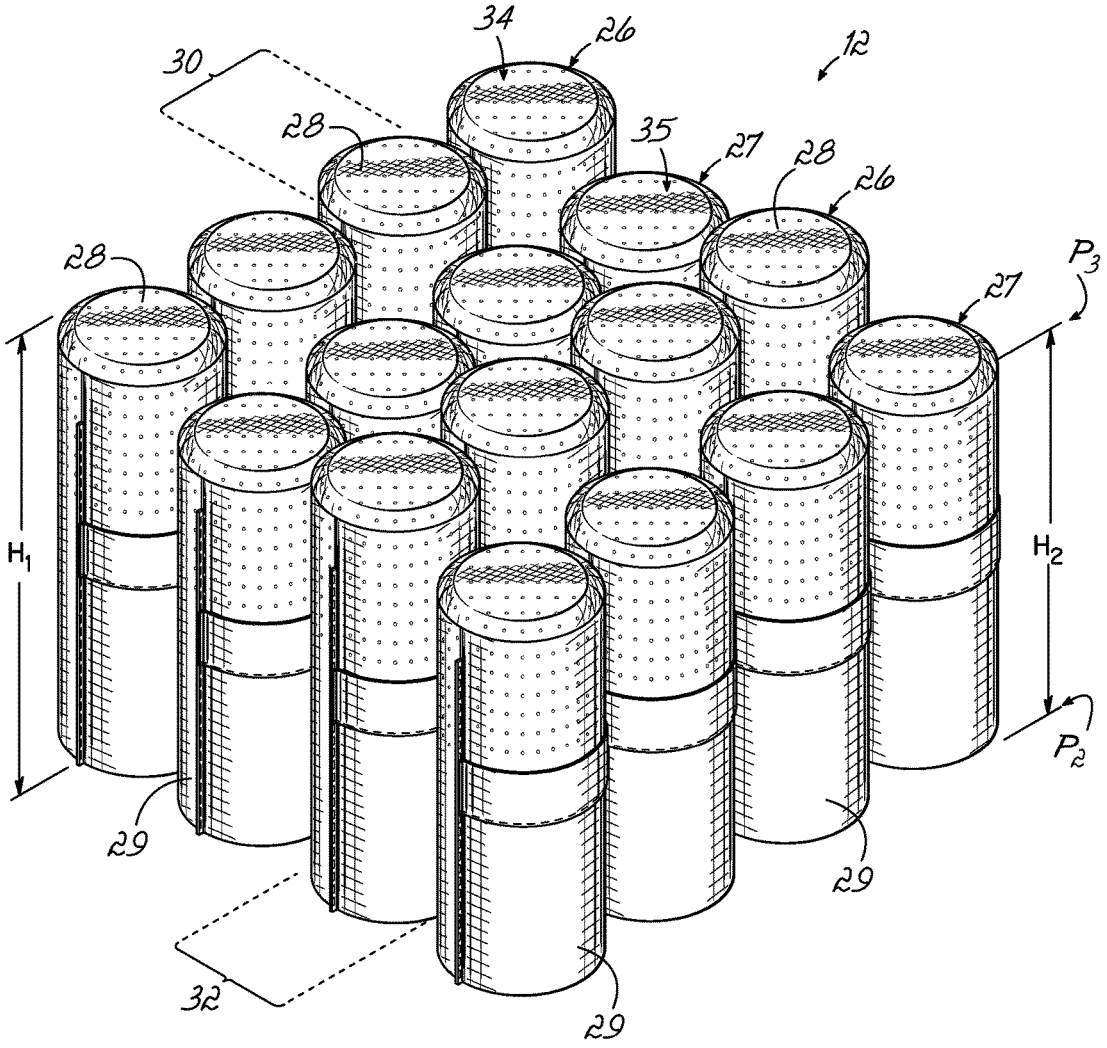
FIG. 6 is a perspective view of a portion of the pocketed spring assembly of FIG. 1 in a relaxed condition.
Figure 7:
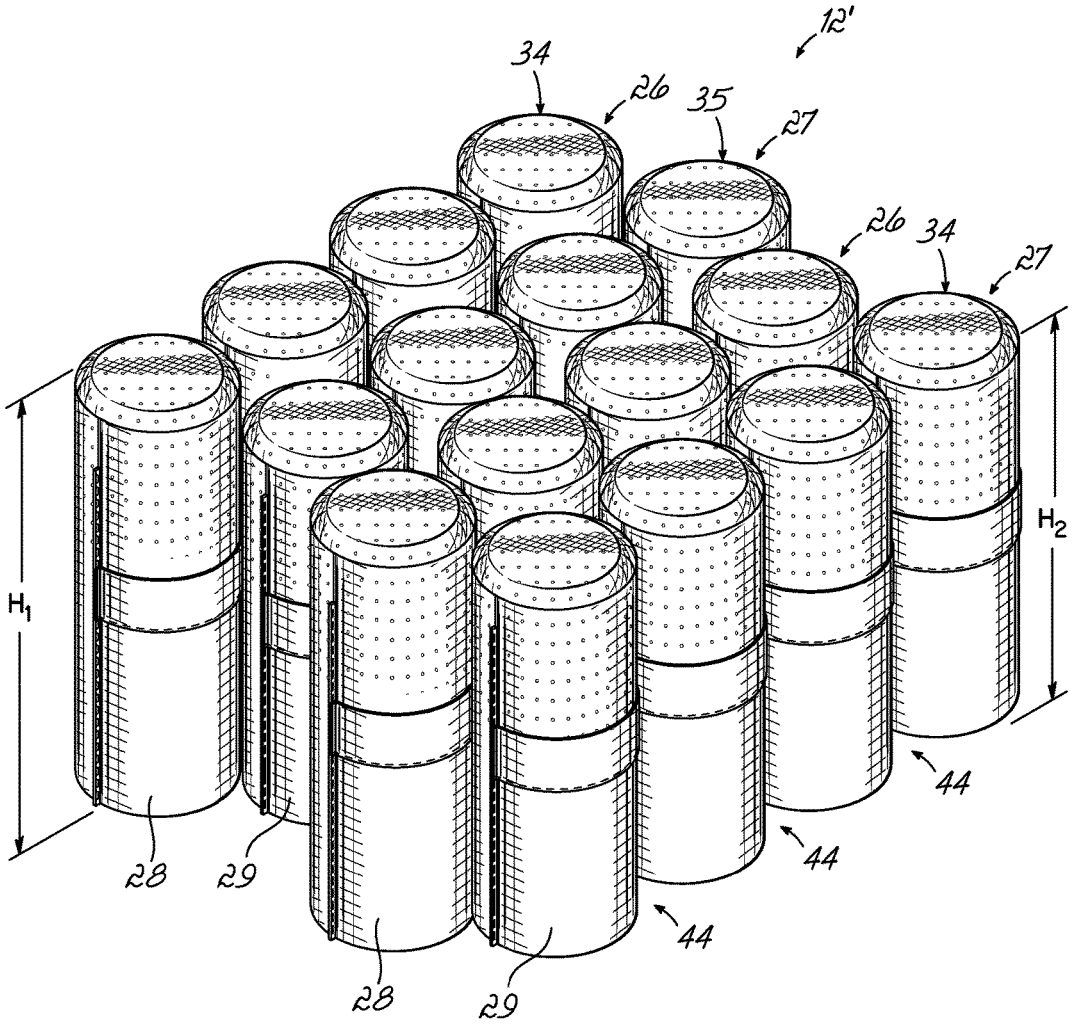
FIG. 7 is a perspective view of a portion of another pocketed spring assembly in a relaxed condition, the strings of springs being offset from one another.

Referring to FIGS. 6 and 7, the strings of springs 26, 27 of pocketed spring assembly 12 and the strings of springs 26*a*, 27*a* of pocketed spring assembly 12*a*, along with any other strings of springs described or shown herein, may be joined so that the individually pocketed springs 28 are aligned in transversely extending rows 30 and longitudinally extending columns 32. Alternatively, the strings of springs 26, 27 of pocketed spring assembly 12 and the strings of springs 26*a*, 27*a* of pocketed spring assembly 12*a* may be offset from one another. In such an arrangement, shown in FIG. 7, the individually pocketed springs 28, 29 are not aligned in rows and columns; instead, the individually pocketed springs 28, 29 fill gaps or voids 44 of the adjacent strings of pocketed springs. FIG. 7 shows a portion of a pocketed spring assembly 12' with multiple strings of springs 26, 27 arranged in this offset manner. Either alignment of strings of springs may be incorporated into any of the pocketed spring assemblies or cores illustrated or described herein.

FIG. 2 illustrates a cross-section taken along the line 2-2 of FIG. 1. The pocketed spring assembly 12 is made up of strings of springs 26, 27 of different heights. As shown in FIG. 2, the pocketed spring assembly 12 comprises two border sections 31 and an interior section 32 therebetween. More specifically, the two outermost longitudinally extending strings of springs 26 on each side of pocketed spring assembly 12 have a first height H1 and may provide edge support. These strings of springs 26 may be considered border strings of springs or "tall" strings of springs in this document. As best shown in FIG. 2, pocketed spring assembly 12 further comprises longitudinally extending strings of springs 27 of a second height H2, shorter than the "tall" strings of springs 26. These strings of springs 27 may be considered "short" strings of springs in this document. Between border strings of springs 26, the interior 32 of pocketed spring assembly 12 comprises alternating "tall" and "short" strings of springs 26, 27. See FIG. 2.

Although the drawings show two longitudinally extending columns of "tall" strings of springs 26 along each side of pocketed spring assembly 12, any number of "tall" strings of springs 26 may be used as side borders. Similarly, although the drawings show two transversely extending rows of "tall" strings of springs 26*a* along each end of the pocketed spring assembly 12*a*, any number of rows of "tall" strings of springs 26*a* may be located along each end of pocketed spring assembly 12*a*.

In pocketed spring assembly 12*a* shown in FIG. 1A, the two outermost rows 30 of pocketed springs at each end of the product 10*a* or strings of springs are the "tall" strings of springs 26. The interior strings of springs between the two end rows 30 alternate between "tall" and short strings of springs 26, 27.

Although not shown, it is within the contemplation of the present invention that the border sections 31 be omitted and the entire pocketed spring assembly comprises alternating "short" and "tall" strings of springs. Such a configuration of strings of pocketed springs may exist regardless of whether the strings of springs extend longitudinally, as in pocketed spring assembly 12, or transversely, as in pocketed spring assembly 12*a*.

Figure 3:
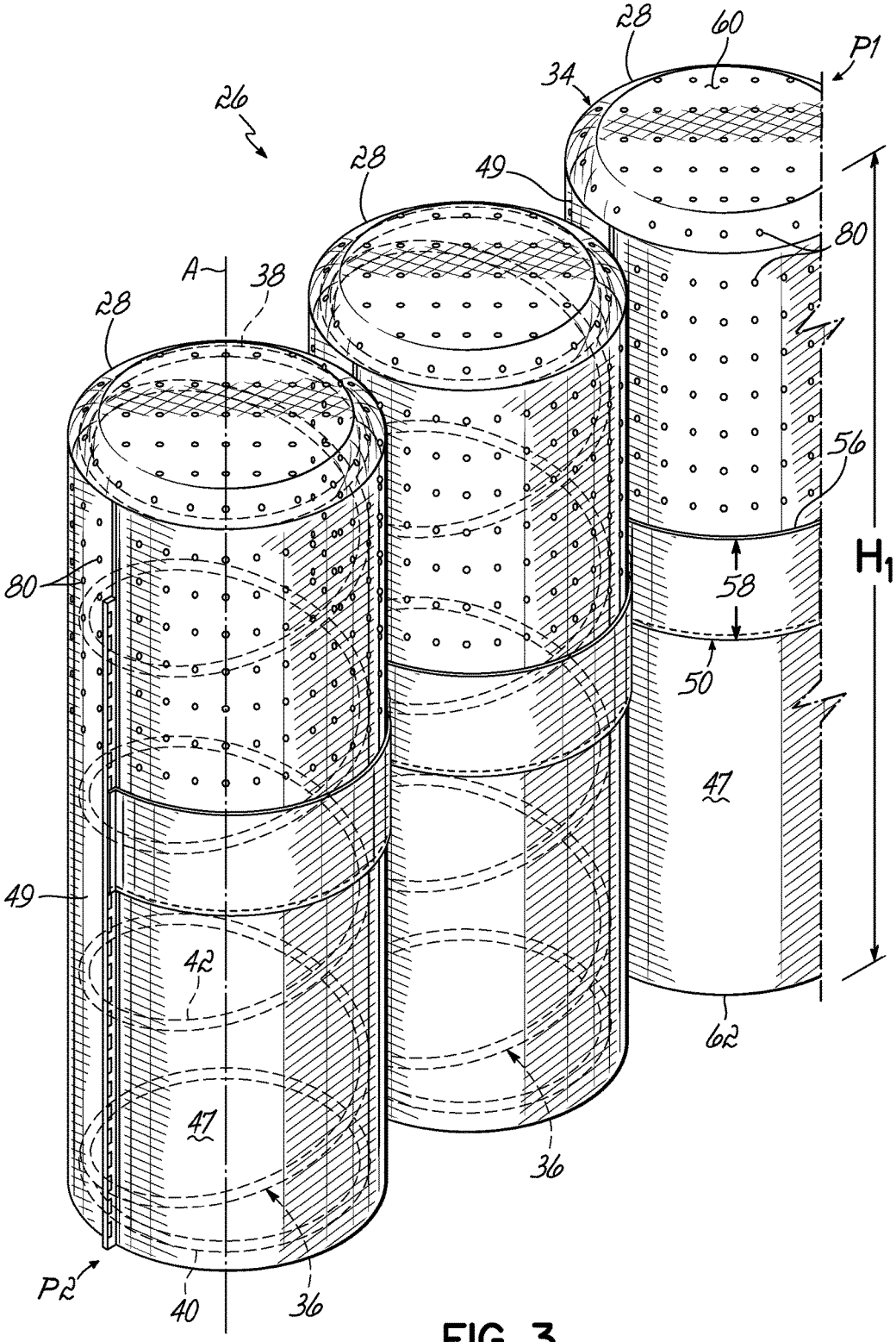
FIG. 3 is a perspective view, partially broken away, of a portion of one of the "tall" strings of springs of FIG. 1 in an unloaded condition.
Figure 4A:
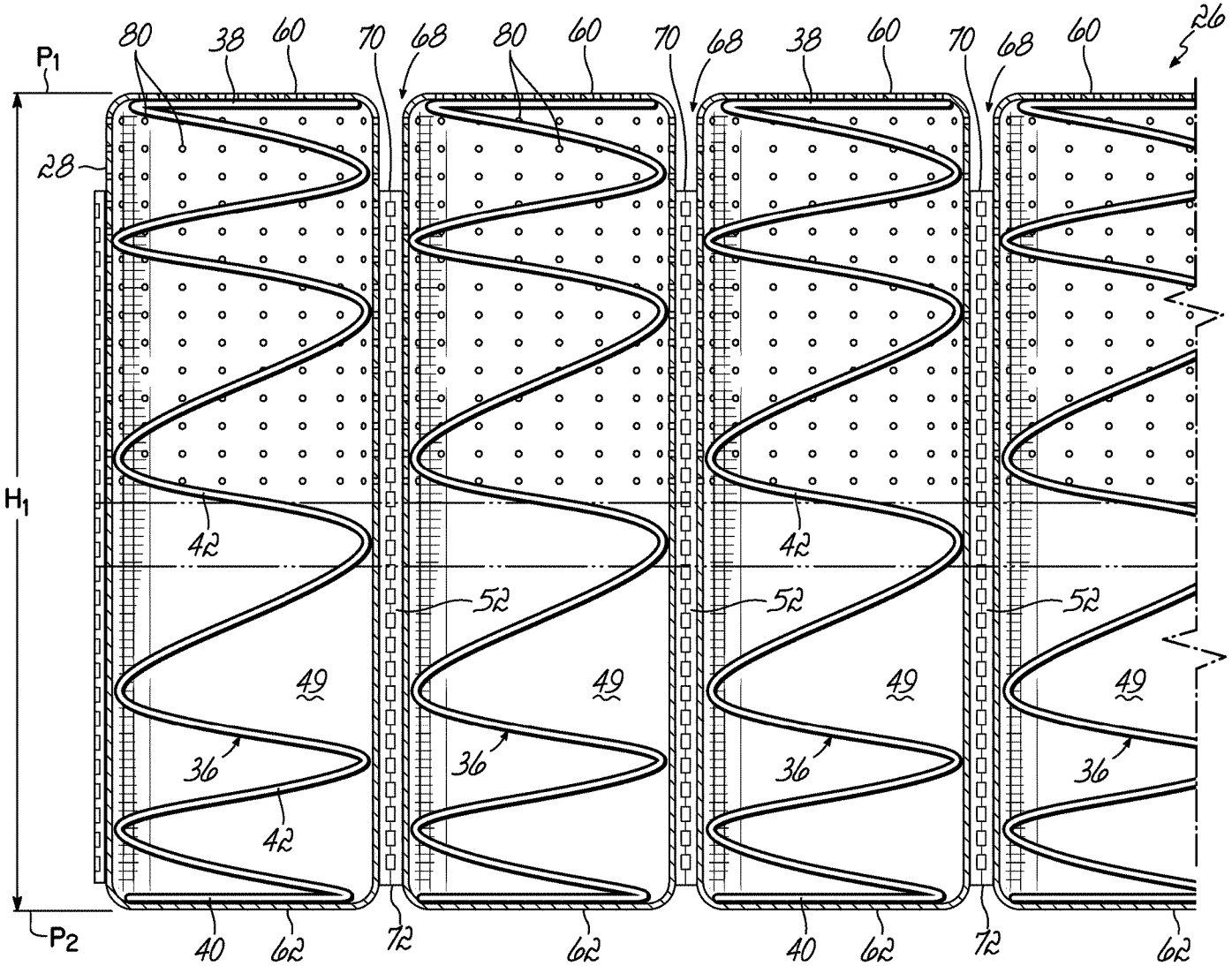
FIG. 4A is a cross-sectional view, partially broken away, of a portion of one of the "tall" strings of springs of FIG. 1 in an unloaded condition.
Figure 4B:
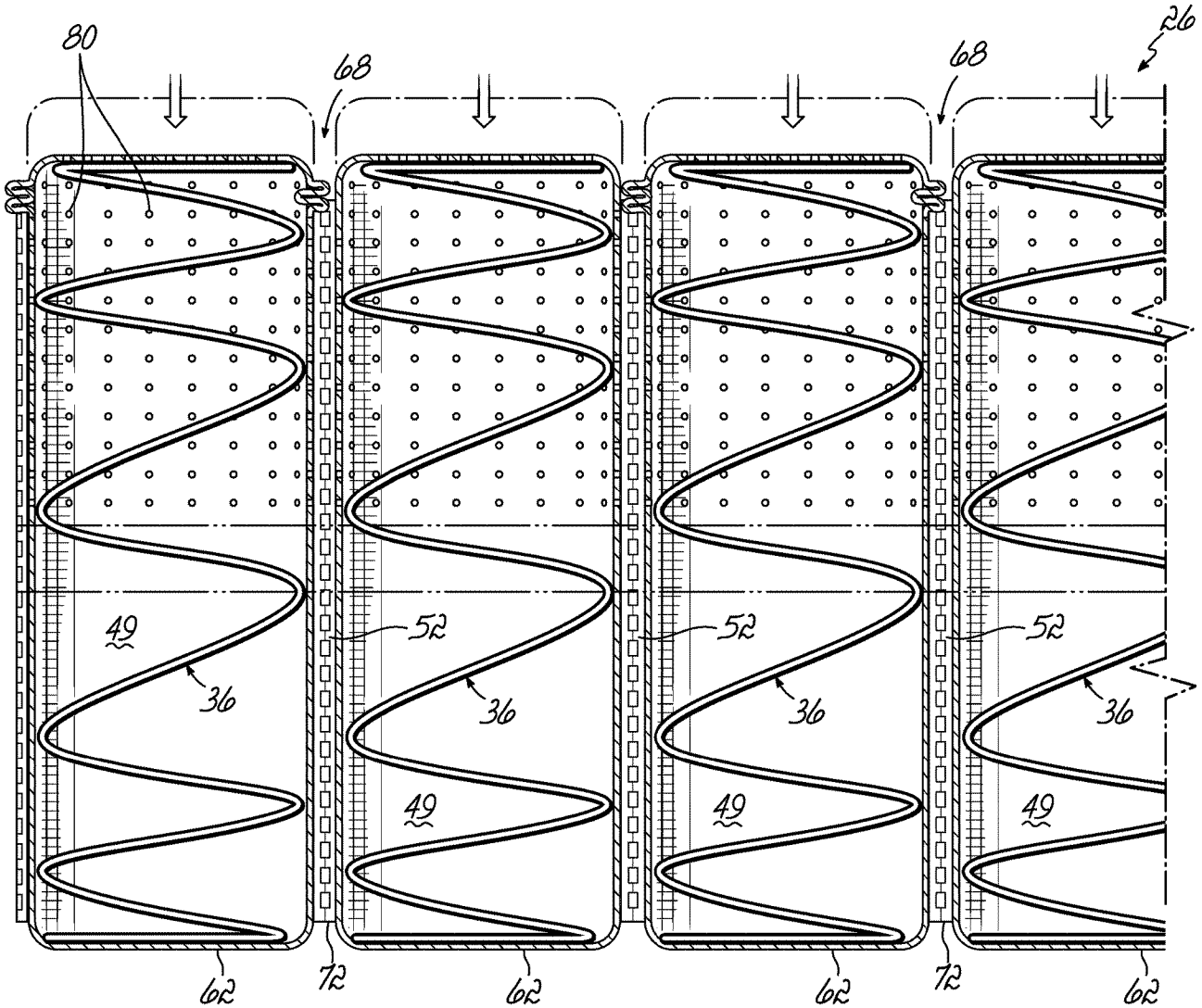
FIG. 4B is a view similar to FIG. 4A, the "tall" string of springs of FIG. 4A being in a loaded condition.

As best illustrated in FIGS. 3, 4A and 4B, each "tall" string 26 of pocketed springs 28 comprises a row of interconnected fabric pockets 34. Each of the fabric pockets 34 contains at least one coil spring 36. The coil spring 36 is preferably made of one piece of wire of a uniform diameter, but may be made of other materials, multiple strands of twisted wire and/or may be a non-uniform diameter, such as a barrel-shaped spring 90 shown in FIG. 14. As best shown in FIG. 3, each coil spring 36 has a central or longitudinal axis A, an upper end turn 38, a lower end turn 40 and a plurality of central convolutions 42 between the end turns. FIGS. 3 and 4A illustrate a coil spring 36 in which the diameter of the end turns 38, 40 is generally identical to the diameter of the central convolutions 42.

Preferably, one piece of fabric is used to create the string of pocketed springs 26, the piece of fabric being folded over onto itself around the coil springs 36. As best shown in FIG. 3, opposite sides or plies 47, 49 of the fabric are sewn, welded or otherwise secured together in order to create a longitudinal seam 50 and a plurality of separating or transverse seams 52. FIG. 2 illustrates ply 47 being closest to the reader and ply 49 being behind the springs 36.

As best shown in FIG. 3, opposed edges 56 of the piece of fabric used to create the string of pocketed springs 26 are aligned and spaced from the longitudinal side seam 50 a distance indicated by numeral 58. Although the drawings indicated the longitudinal seam 50 being below the free edges 56 of the piece of fabric, the longitudinal seam 50 may be above the free edges 56 of the piece of fabric.

As shown in FIGS. 3 and 4A, in the absence of being subjected to a load, the string of pocketed springs 26 has a generally planar top surface 60 in a top plane P1 and a parallel generally planar bottom surface 62 in a bottom plane P2. The linear distance between the top and bottom surfaces of the string of pocketed springs 26 defines a height H1 of the string of pocketed springs 26. This linear distance further defines the height H1 of the pocketed spring assembly 12 because each of the strings of springs 26 has the same height.

Figure 5:
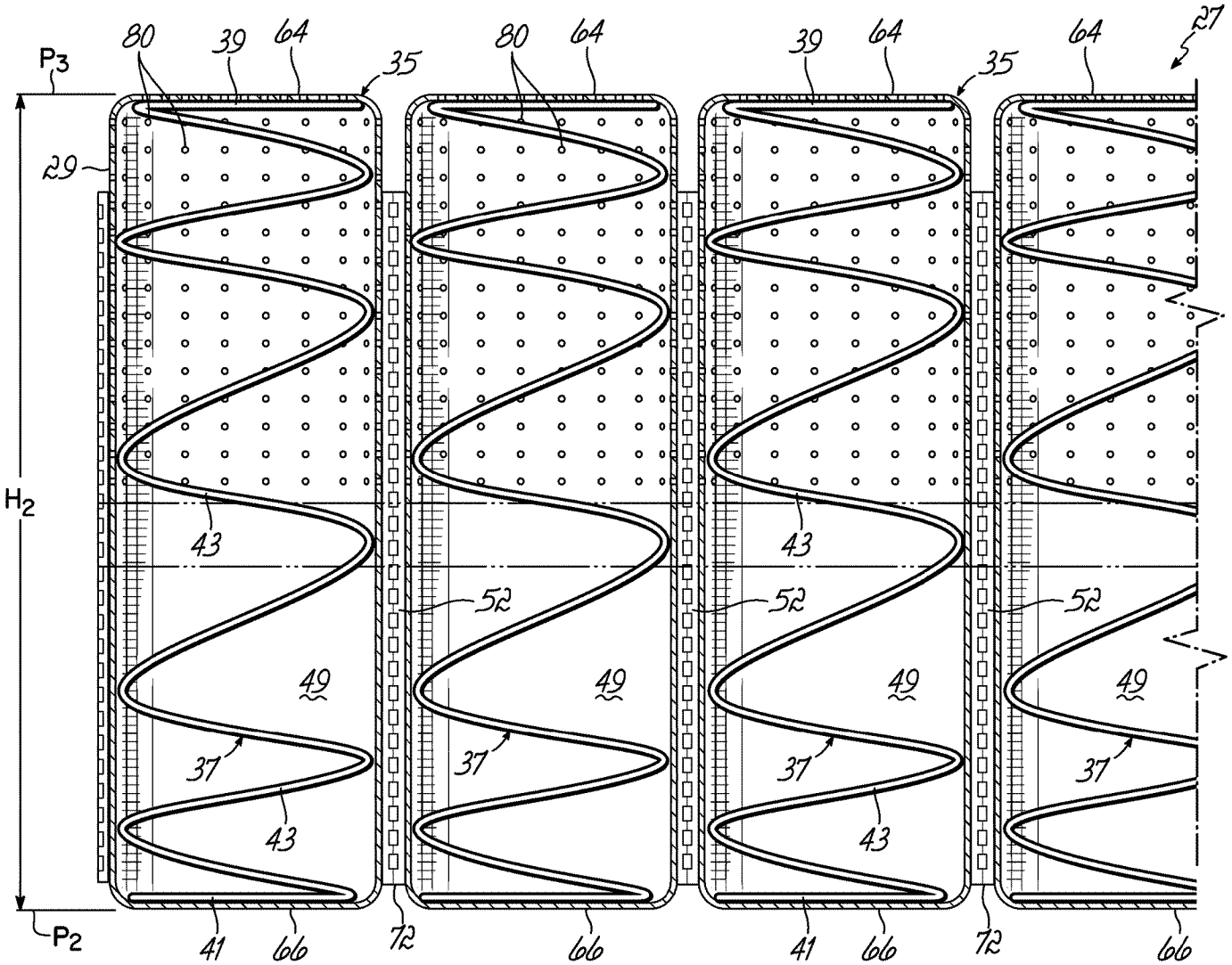
FIG. 5 is a cross-sectional view, partially broken away, of a portion of one of the "short" strings of springs of FIG. 1 in an unloaded condition.

As shown in FIGS. 2 and 5, each "short" string of pocketed springs 27 has a generally planar top surface 64 in a top plane P3 and a parallel generally planar bottom surface 66 in a bottom plane P2. The linear distance between the top and bottom surfaces of the string of pocketed springs 27 defines a height H2 of the "short" string of pocketed springs 27. Inside each pocket of fabric 35, a coil spring 37 is located. Each coil spring 37 has an upper end turn 39, a lower end turn 41 and a plurality of central convolutions 43 between the end turns, all of the same diameter.

As best shown in FIG. 4A, in "tall" strings 26 of pocketed springs 28, the transverse seams 52 forming the adjacent fabric pockets 34 are divided as at 68 to thereby form a cut, slit, or notch by, for example, cutting, slitting, severing, melting, or the like, from the upper surface 60 of the string of pocketed springs 26 inwardly (downwardly as illustrated), so as to partially separate the adjacent fabric pockets 34 and pocketed springs 28. Preferably, the divide 68 extends to beyond or below the upper end turns 38 and at least one central convolution 42 of adjacent "tall" coil springs 36. As best shown in FIG. 4, the transverse seams 52 of the "tall" strings of springs 26 each have an upper end 70 located at the bottom of each divide 68 and a lower end 72. As shown in FIG. 4A, the upper end 70 of each transverse seam 52 is located below the upper end turn 38 and multiple convolutions 42 of adjacent coil springs 36 when the coil springs 36 are in a relaxed condition.

Although the seams or welds in all of the embodiments shown herein are shown as being heat welded spaced rectangles, any of the seams may be spaced dots, triangles or solid line segments without spaces.

The significance of divide 68 may be appreciated with reference to FIG. 4B. Divide 68 essentially decouples each coil spring 36 from its adjacent coil spring 36 during initial deflection of coil spring 36. This creates more of an individual coil performance and allows the coil spring 36 to engage a person sleeping on the mattress 10 sooner while giving the person a softer feel at the beginning of the coil deflections. It is believed that this arrangement provides a more comfortable product 10.

As the drawings show, each of the strings of springs 26, 27 of pocketed spring assembly 12 and strings of springs 26*a*, 27*a* of pocketed spring assembly 12*a* have ventilation openings 80 extending through a portion of the fabric. As best shown in FIGS. 2 and 3, the ventilation openings 80 exist in the upper or top surfaces 60 of the fabric pockets 34, 35 and above the side seams 50 of the fabric pockets 34, 35. Although the drawings illustrate the ventilation openings 80 located in approximately an upper half of the strings of springs 26, 26*a*, 27 and 27*a*, they may be located in only an upper third or upper quarter of the strings of springs. In other words, the drawings are not intended to be limiting regarding the location, size, shape or number of ventilation openings. For example, the ventilation openings may be oval or rectangular instead of circular. Although the fabric used in any of the embodiments shown or described may be breathable, allowing some airflow through the fabric, the ventilation openings allow increased airflow through the strings of springs and spring assembly, resulting in a cooler product.

Figure 8:
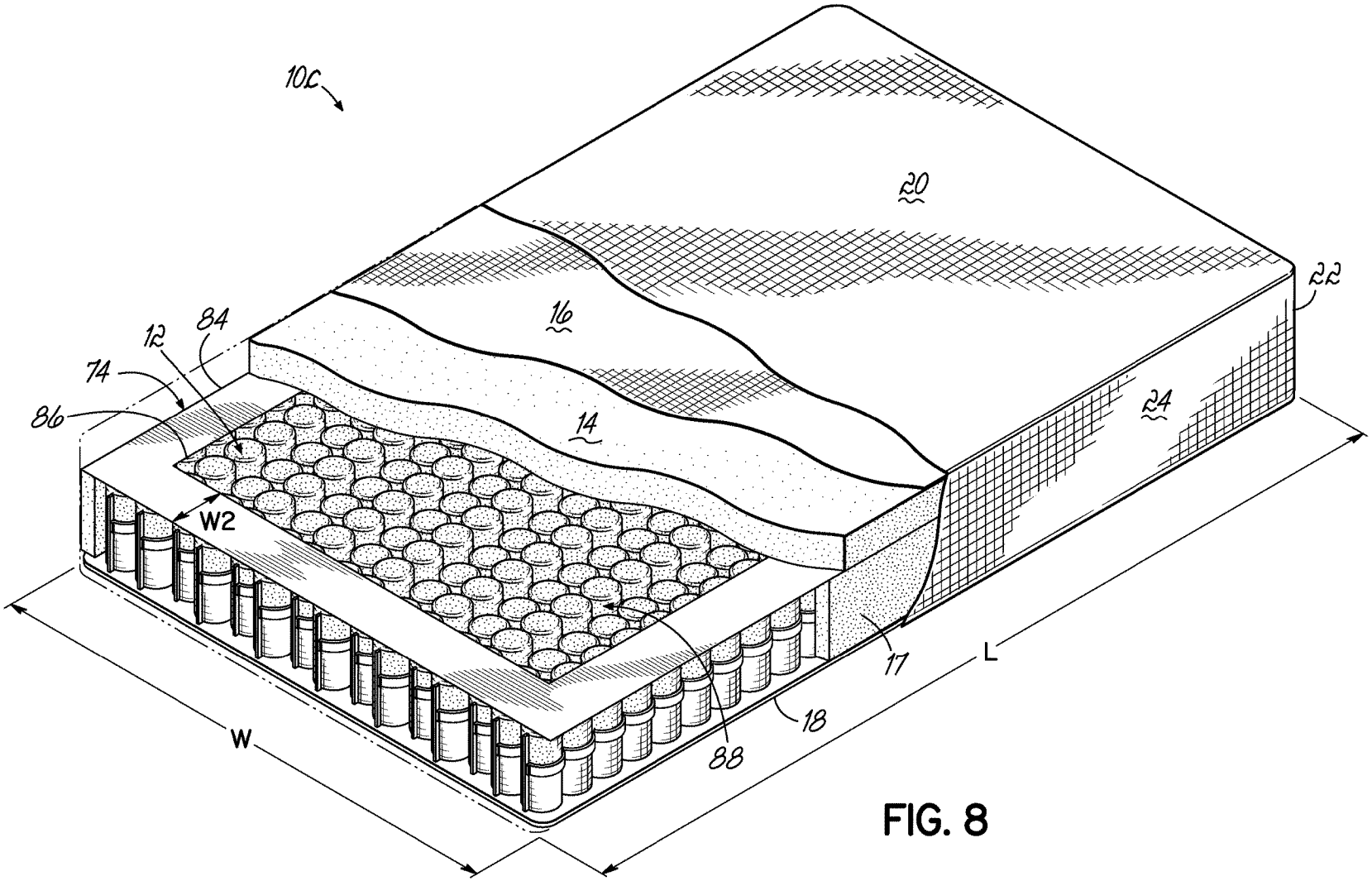
FIG. 8 is a perspective view, partially broken away, of a single-sided bedding product incorporating an upper scrim sheet in the form of a picture frame.

FIG. 8 illustrates a single-sided mattress 10*c* comprising a pocketed spring assembly 12 and border 17 identical to those shown in the mattress 10 of FIG. 1. However, in addition, a picture frame-shaped upper scrim sheet 74 is secured to the upper surfaces 60 of the "tall" strings of springs 26 around the perimeter of the mattress 10*c*. The upper scrim sheet 74, in conjunction with the ventilation openings 80 in the fabric of the strings of springs 26, 27, increases airflow into and out of the product 10*c*. This increased airflow functions to cool the interior of the product. The scrim sheet 74 has an outer edge 84 and an inner edge 86, the linear distance between which defines the width W2 of the upper scrim sheet 74. The generally rectangular inner edge 86 defines a central opening 88 which assists the airflow into and out of the pocketed spring assembly 12. Such a picture frame upper scrim sheet may be used in any of the embodiments shown or described herein with any of the pocketed spring assemblies shown or described herein.

Figure 13:
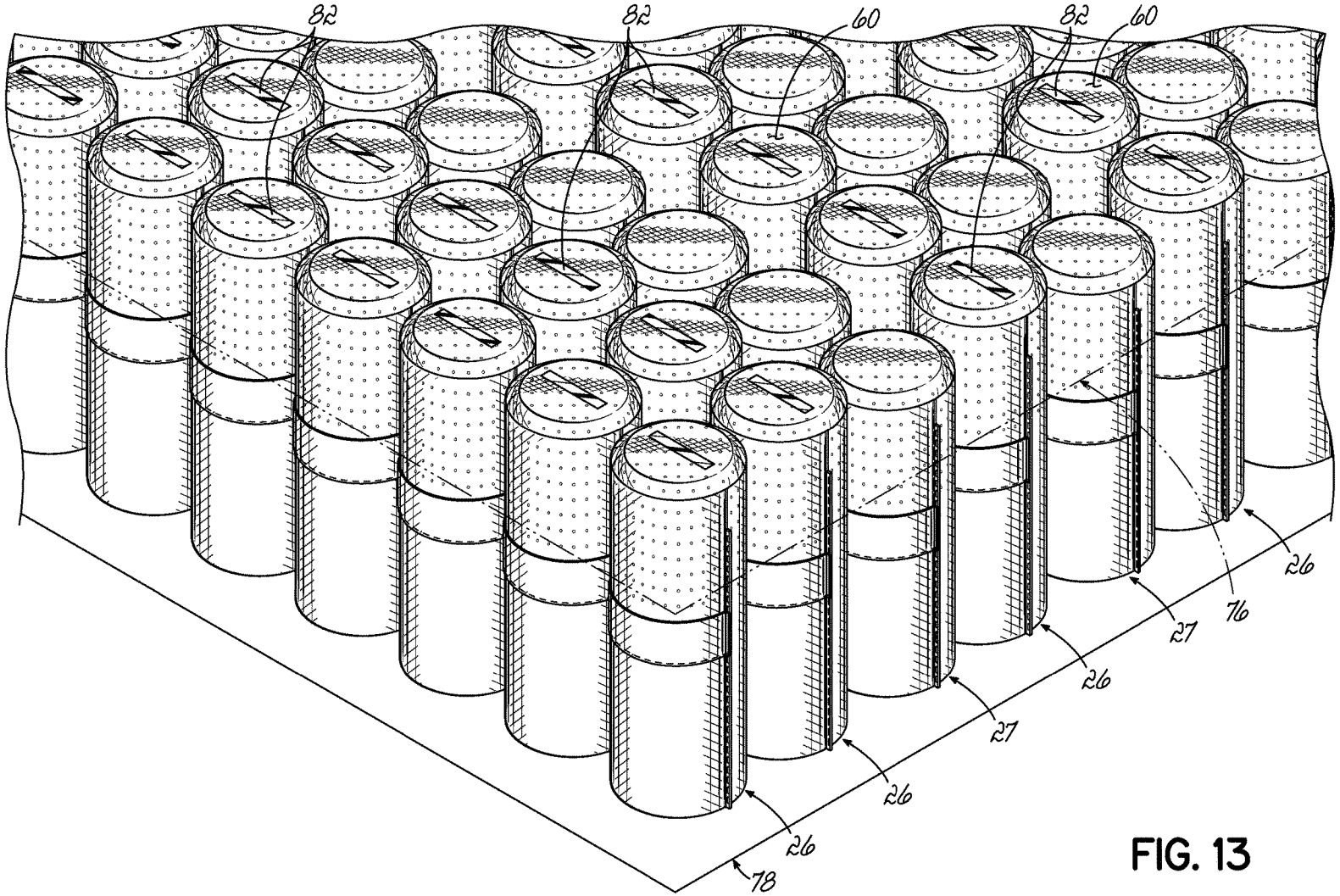
FIG. 13 is a perspective view, partially broken away, of a portion of a bedding or seating product incorporating top and bottom scrim sheets.

Alternatively, as shown in FIG. 13, a generally rectangular upper scrim sheet 76 lacking a central opening may be secured to the upper surfaces 60 of the "tall" strings of springs 26 along linear segments 82 or in any other conventional manner. As shown in FIG. 13, the base may be a lower scrim sheet 78 alone secured to the lower or bottom surfaces of at least some of the strings of springs 26, 27. Cushioning materials may be used below the lower scrim sheet 78. Such solid rectangular scrim sheets may be used in any of the embodiments shown or described herein with any of the pocketed spring assemblies shown or described herein.

Figure 9:
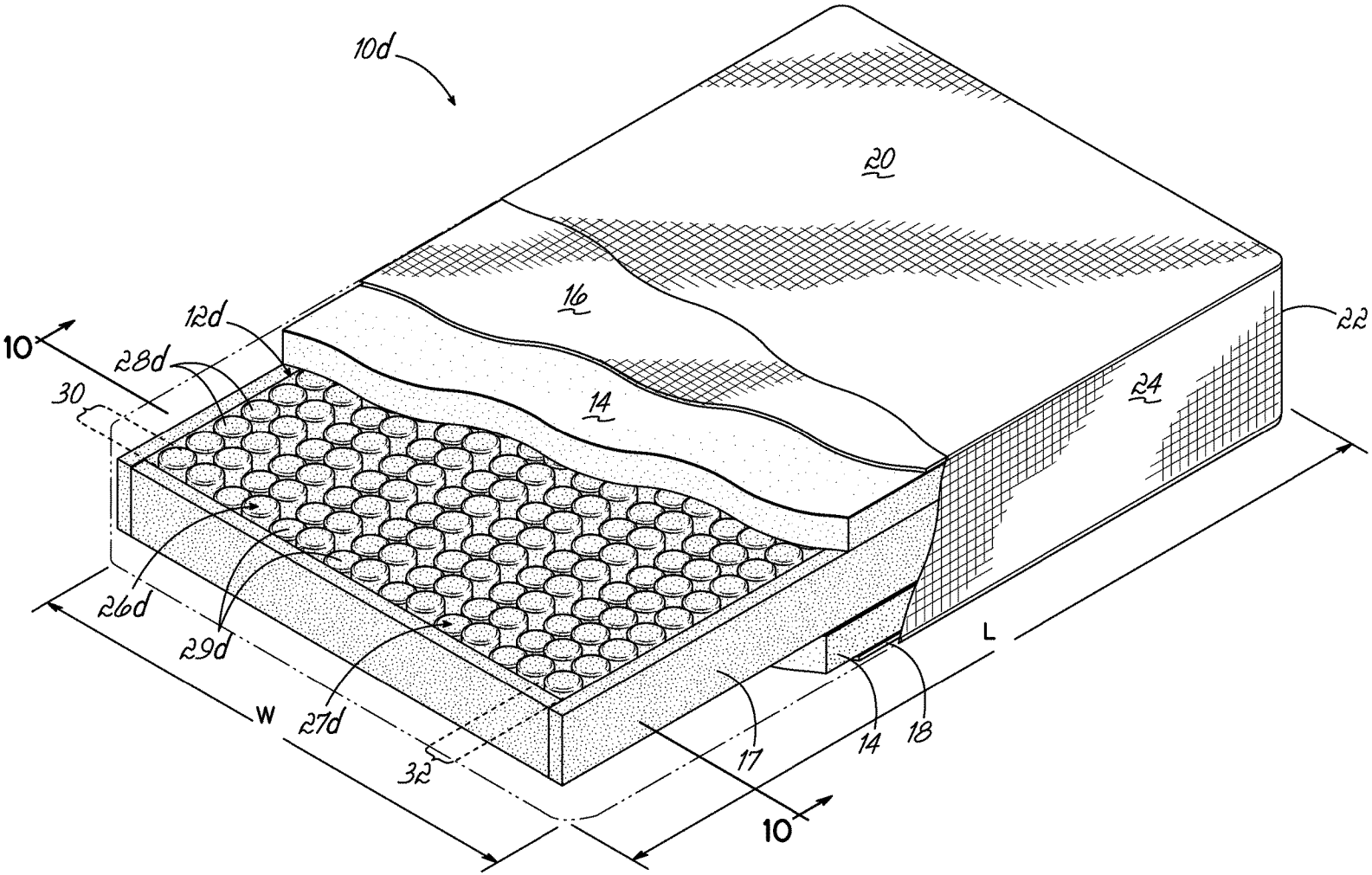
FIG. 9 is a perspective view, partially broken away, of a double-sided bedding product incorporating another pocketed spring assembly.
Figure 10:
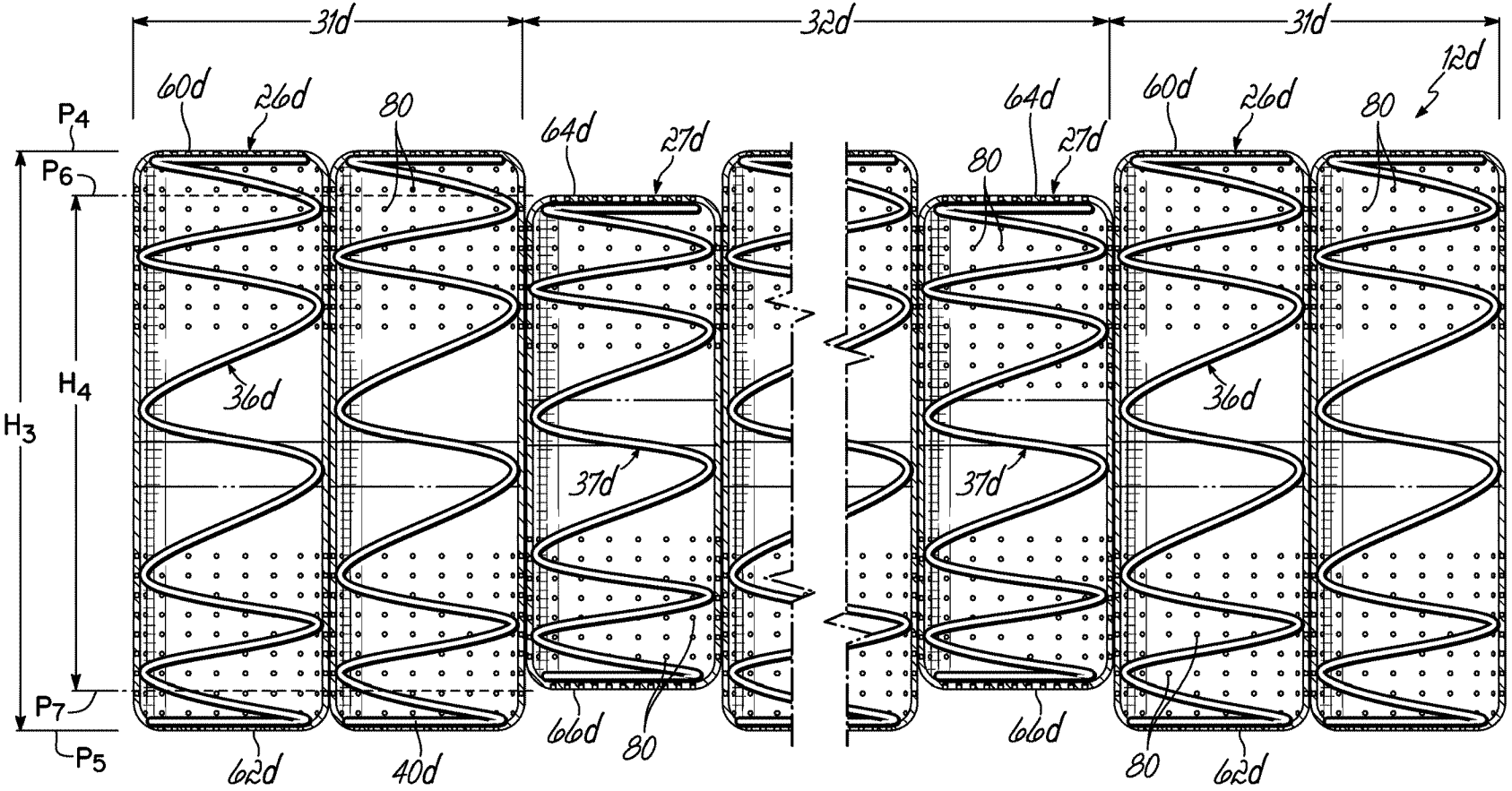
FIG. 10 is a cross-sectional view, partially broken away, taken along the line 10-10 of FIG. 9.
Figure 11:
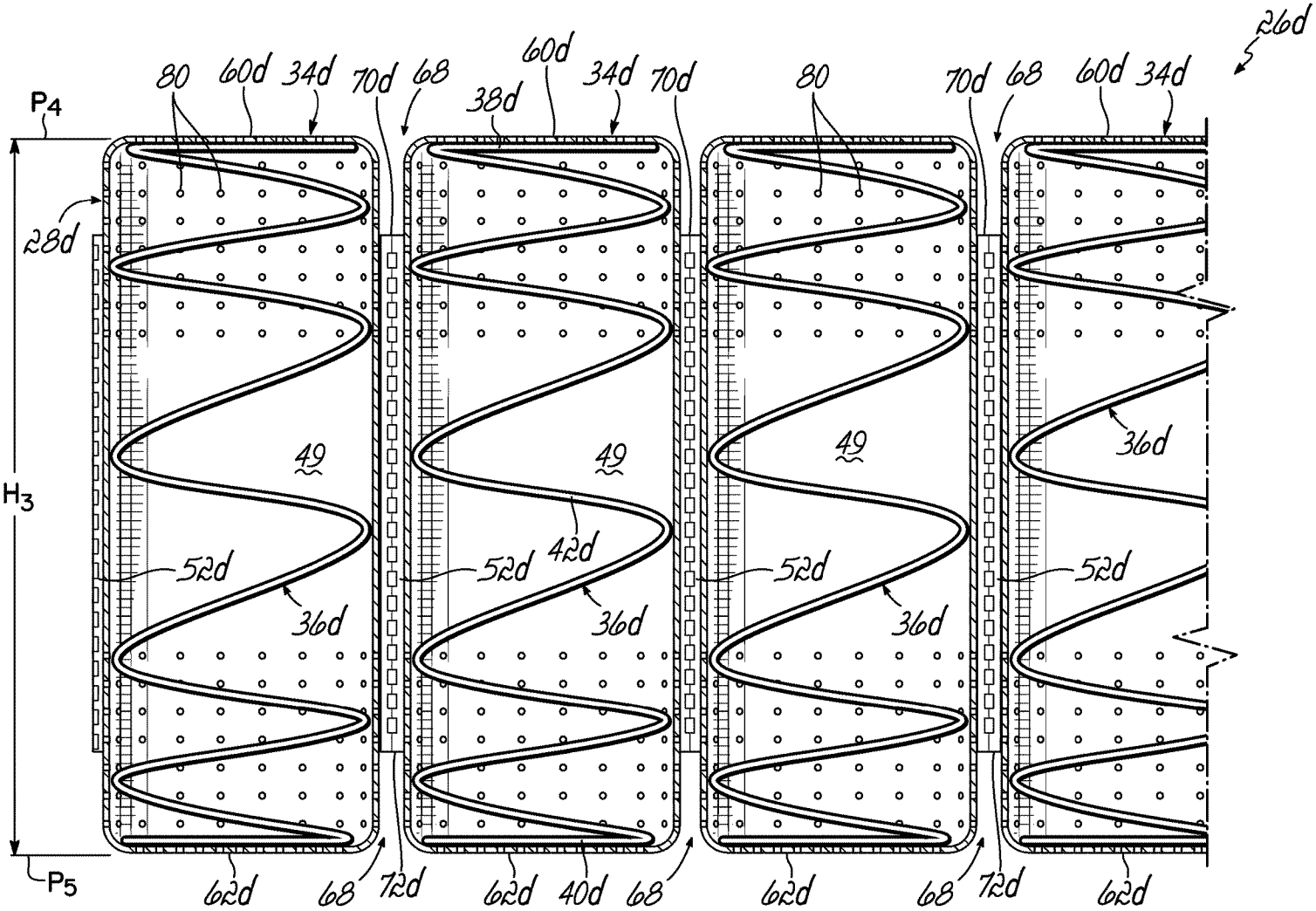
FIG. 11 is a cross-sectional view, partially broken away, of one of the "tall" strings of springs of the pocketed spring assembly of FIG. 9 in an unloaded condition.

Referring now to FIGS. 9-11, while the mattresses 10 and 10*a* illustrated in FIGS. 1 and 1A, respectively, are single-sided mattresses, any other pocketed spring assembly shown or described herein, may be incorporated into any bedding or seating product, including a double-sided mattress or seating cushion.

Figure 12:
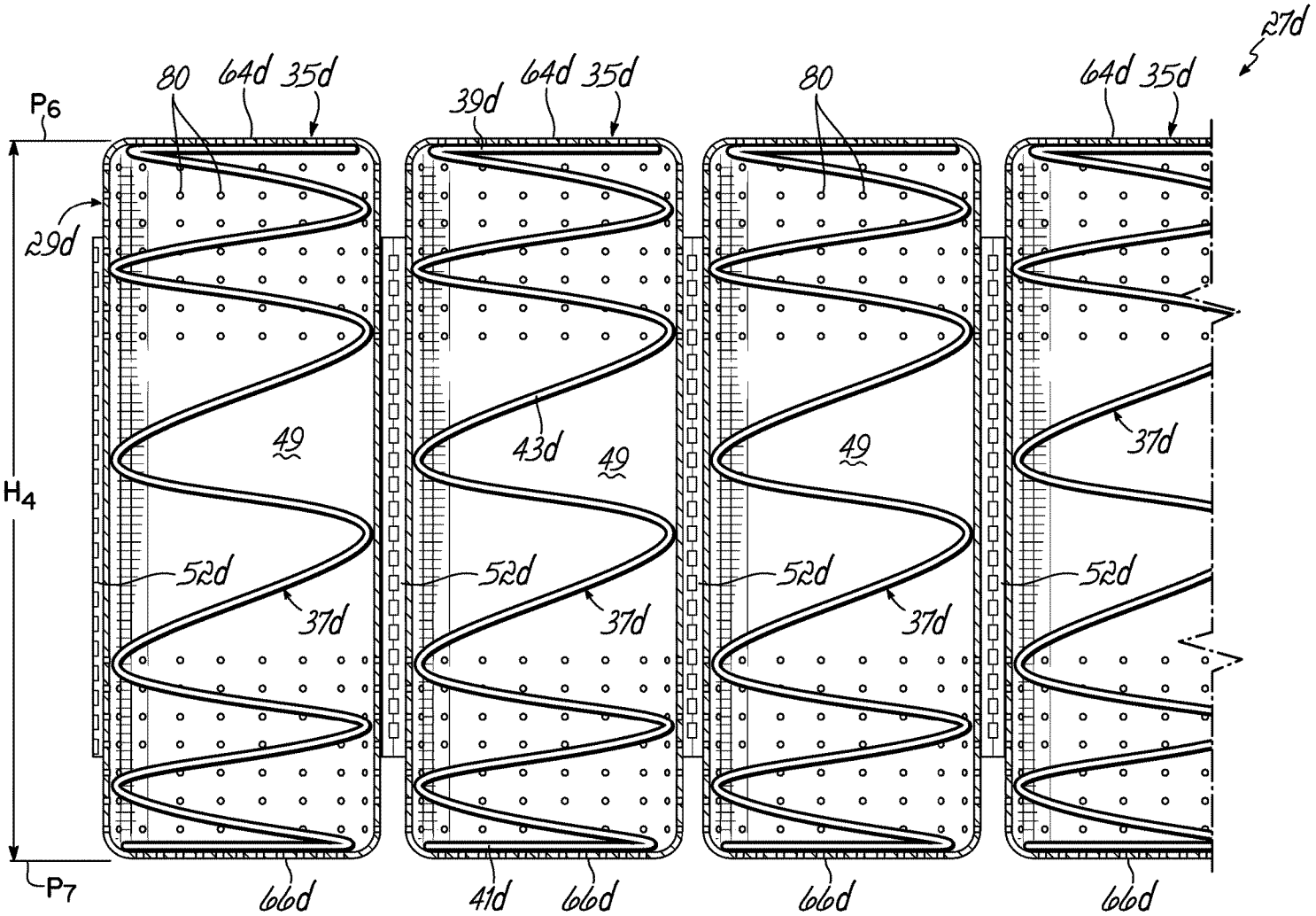
FIG. 12 is a cross-sectional view, partially broken away, of one of the "short" strings of springs of the pocketed spring assembly of FIG. 9 in an unloaded condition.

FIG. 9 illustrates a double-sided mattress 10*d* comprising a pocketed spring assembly 12*d* shown in detail in FIGS. 10-12. However, the mattress 10*d* of FIG. 9 has conventional padding layers 14, 16 above and below a double-sided pocketed spring assembly 12*d*. The double-sided pocketed spring assembly 12*d* comprises a plurality of strings of pocketed springs 26*d*, 27*d* both being partially shown in cross-section in FIG. 10. FIG. 11 illustrates one of the "tall" strings of springs 26*d* in a relaxed condition. FIG. 12 illustrates one of the "short" strings of springs 27*d* in a relaxed condition.

FIG. 10 illustrates a cross-section taken along the line 10-10 of FIG. 9. The pocketed spring assembly 12*d* is made up of longitudinally extending strings of springs 26*d*, 27*d* of different heights. As shown in FIG. 10, the pocketed spring assembly 12*d* comprises two border sections 31*d* and an interior section 32*d* therebetween. More specifically, the two outermost longitudinally extending strings of springs 26*d* on each side of pocketed spring assembly 12*d* have a first height H3 and may provide edge support. These strings of springs 26*d* may be considered border strings of springs or "tall" strings of springs for purposes of this document. As best shown in FIG. 10, pocketed spring assembly 12*d* further comprises longitudinally extending strings of springs 27*d* of a second height H4, shorter than the "tall" strings of springs 26*d*. These strings of springs 27*d* may be considered "short" strings of springs for purposes of this document. Between border strings of springs 26*d*, the interior 32*d* of pocketed spring assembly 12*d* comprises alternating "tall" and "short" strings of springs 26*d*, 27*d*. See FIG. 10.

FIG. 11 illustrates a portion of one of the strings of springs 26*d* used in a double-sided mattress, like mattress 10*d* shown in FIG. 9. The fabric pockets 34*d* of such strings of springs 26*d* are slightly different than the fabric pockets 34 of string of springs 26. There are divides 68 along the tops and bottoms of the string of springs 26*d*. Each of the transverse seams 52*d* has an upper edge 70*d* and a lower edge 72*d*.

As best illustrated in FIG. 11, each string 26*d* of pocketed springs 28*d* comprises a row of interconnected fabric pockets 34*d*. Each of the fabric pockets 34*d* contains at least one coil spring 36*d*. The coil spring 36*d* is preferably made of one piece of wire of a uniform diameter, but may be made of other materials, multiple strands of twisted wire and/or may be a non-uniform pitch and/or diameter. As shown in FIG. 10, each "short" string of springs 27*d* is identically made except with shorter coil springs 37*d* therein.

As shown in FIGS. 10 and 11, the "tall" string of pocketed springs 26*d* has a generally planar top surface 60*d* in a top plane P4 and a parallel generally planar bottom surface 62*d* in a bottom plane P5. The linear distance between the top and bottom surfaces of the "tall" string of pocketed springs 26*d* defines a height H3 of the "tall" string of pocketed springs 26*d*. This linear distance further defines the height of the two-sided pocketed spring assembly 12*d* because each of the "tall" strings of springs 26*d* has the same height.

As shown in FIGS. 10 and 12, each of the "short" strings of pocketed springs 27*d* has a generally planar top surface 64*d* in a top plane P6 and a parallel generally planar bottom surface 66*d* in a bottom plane P7. The linear distance between the top and bottom surfaces of the string of pocketed springs 27*d* defines a height H4 of the "short" string of pocketed springs 27*d*. The height H4 of each of the "short" strings of springs 27*d* is identical, less than the height H3 of the "tall" strings of springs 26*d*. Inside each pocket of fabric 35*d*, a coil spring 37*d* is located. As shown in FIG. 12, each "short" coil spring 37*d* has an upper end turn 39*d*, a lower end turn 41*d* and a plurality of central convolutions 43*d* between the end turns, all of the same diameter.

In accordance with an embodiment of the present invention, in strings 26*d* of pocketed springs 28*d*, the transverse seams 52*d* forming the adjacent fabric pockets 34*d* are divided at each end as at 68 to thereby form a cut, slit, or notch by, for example, cutting, slitting, severing, melting, or the like, from the upper and lower surfaces 60*d*, 62*d* of the "tall" string of pocketed springs 26*d* inwardly, so as to partially separate the adjacent fabric pockets 34*d*. Preferably, the upper divides 68 extend to beyond or below the upper end turns 38*d* of the springs 36*d*. As best shown in FIG. 11, the transverse seams 52*d* of the "tall" strings of springs 26*d* each have an upper end 70*d* located at the bottom of each divide 68 and an upper end 72*d* located at the top of each divide 68. As shown in FIG. 11, the upper end 70*d* of each transverse seam 52*d* is located below the upper end turn 38*d*, and at least one central convolution 42*d* of the adjacent coil springs 36*d* when the coil springs 36*d* are in a relaxed condition. Similarly, the lower end 72*d* of each transverse seam 52*d* is located above the lower end turn 40*d* and at least one central convolution 42*d* of the adjacent coil springs 36*d* when the coil springs 36*d* are in a relaxed condition.

As the drawings show, each of the strings of springs 26*d*, 27*d* of pocketed spring assembly 12*d* have ventilation openings 80 extending through a portion of the fabric. As best shown in FIGS. 10 and 11, in the "tall" strings of springs 26*d*, the ventilation openings 80 exist in the top and bottom surfaces 60*d*, 62*d* of the fabric pockets 34, 35, and in the upper and lower third of the remainder of the fabric pockets 34*d*, 35*d*. As best shown in FIGS. 10 and 12, in the "short" strings of springs 27*d*, the ventilation openings 80 exist in the top and bottom surfaces 64*d*, 66*d* of the fabric pockets 35*d*, and in the upper and lower third of the remainder of the fabric pockets 35*d*. Although the drawings illustrate the ventilation openings 80 located in approximately an upper and lower third of the strings of springs 26*d*, 27*d*, they may be located in only an upper and lower quarter of the strings of springs. In other words, the drawings are not intended to be limiting regarding the location, size or shape of the ventilation openings.

Figure 14:
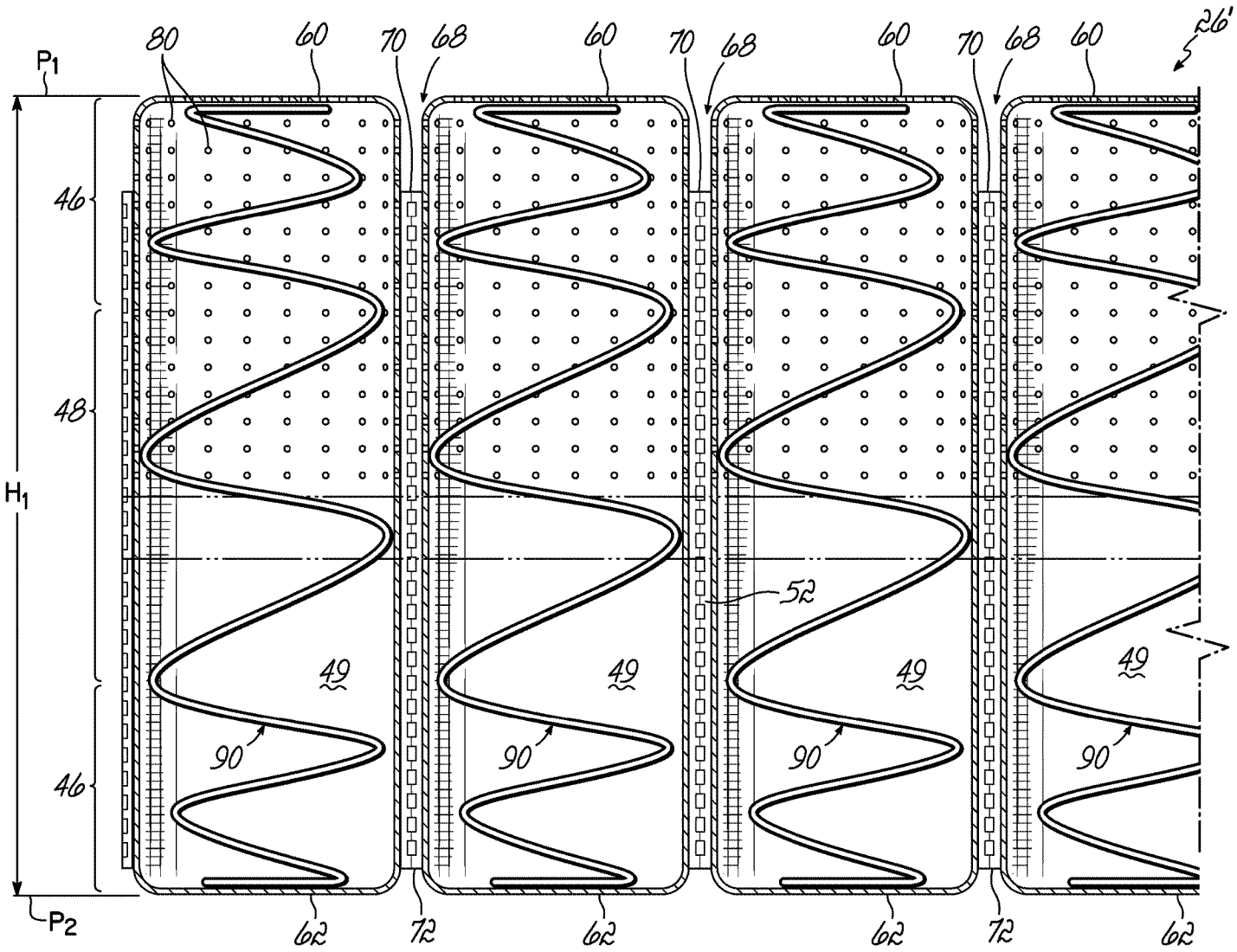
FIG. 14 is a cross-sectional view, partially broken away, of a portion of another string of springs in an unloaded condition.

FIG. 14 illustrates an alternative string of springs 26' in which the coil springs inside the fabric pockets 34 are barrel-shaped coil springs 90. Each barrel-shaped coil spring 90 has two end portions 46 which are identical and a middle portion 48. The end portions 46 each have a narrower diameter than the middle portion 48, as best shown in FIG. 14. Alternatively, any of the coil springs shown or described herein may be as shown and described in U.S. patent application Ser. No. 14/309,099, which is fully incorporated by reference herein. Although not separately shown, the coil springs in any of the strings of springs shown or described herein may be a coil spring therein, which is barrel-shaped.

Figure 15A:
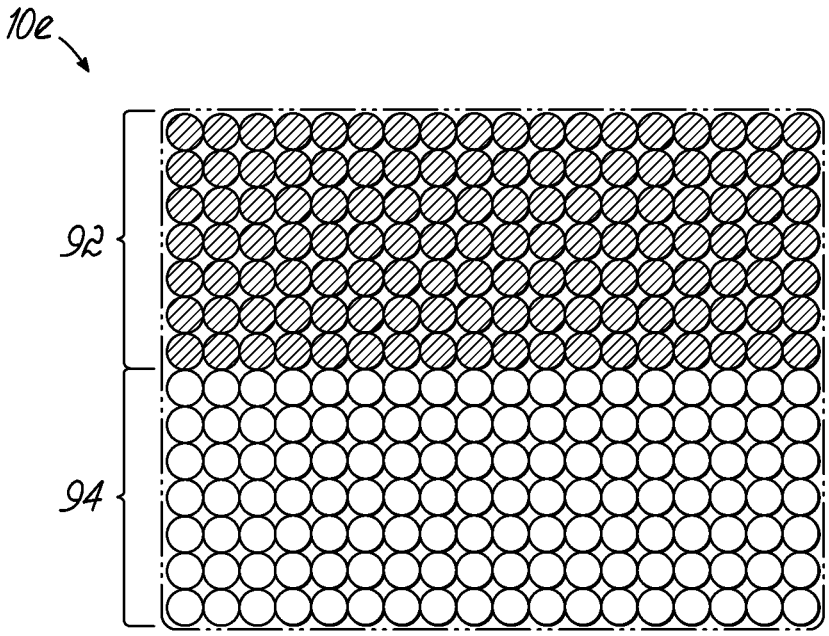
FIG. 15A is a top view of a posturized pocketed spring assembly.

Referring now to FIG. 15A, longitudinally extending strings of springs are shown in one preferable arrangement for a spring core for a bedding or seating product, such as a mattress. As can be seen, the longitudinally extending strings of springs are arranged in a plurality of zones on the mattress 10*e*. By way of example, two zones 92, 94 are illustrated, with the zones corresponding roughly to a "firm" side and a "soft" side. By way of further example, the longitudinally extending strings of springs of the "soft" zone 92 are each strings of springs having the split top feature shown and described herein. The longitudinally extending strings of springs of the "firm" zone 94 are each strings of springs lacking any split top feature. Of course, other arrangements are within the scope of the invention. For example, the mattress shown in FIG. 15A may comprise transversely extending strings of springs rather than longitudinally extending strings of springs. In such an arrangement, each transversely extending string of springs would have to be half firm and half soft. Therefore, each string of springs would have only half the string having the split top feature, the other half lacking such feature.

Figure 15B:
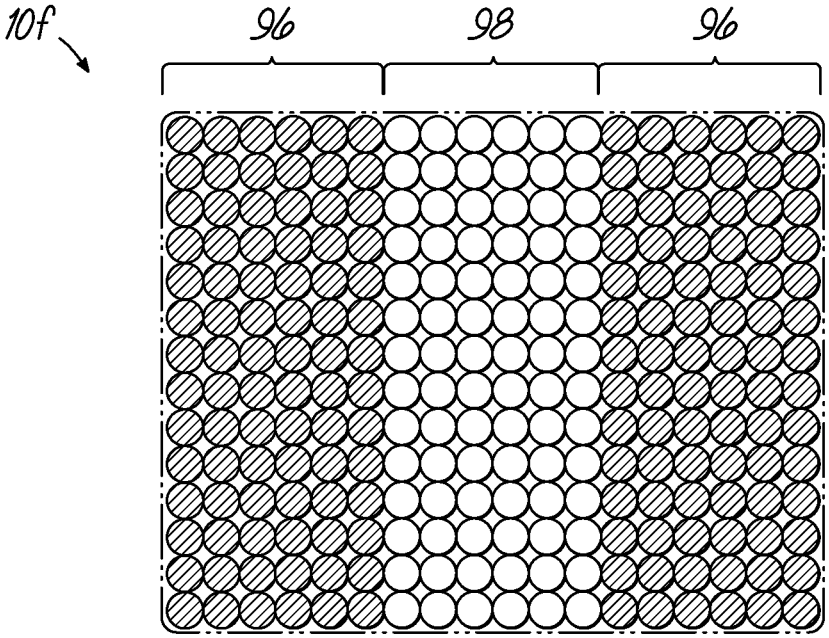
FIG. 15B is a top view of another posturized pocketed spring assembly.

Referring now to FIG. 15B, the transversely extending strings of springs are shown in one preferable arrangement for a spring core for a bedding or seating product, such as a mattress 10*f*. As can be seen, the transversely extending strings of springs are arranged in a plurality of zones on the mattress 10*f*. By way of example, three zones are illustrated, with the zones corresponding roughly to the location of a sleeper's head and shoulders, mid-section, knees and feet. By way of further example, the two end "soft" zones 96 each comprise strings of springs having the split top feature shown and described herein. The transversely extending strings of springs of the middle or "firm" zone 98 are each strings of springs lacking any split top feature. Of course, other arrangements are within the scope of the invention. For example, the mattress shown in FIG. 15B may comprise longitudinally extending strings of springs, rather than transversely extending strings of springs. In such an arrangement, each longitudinally extending string of springs would have to be divided into three sections; a middle "firm" section and two end or "soft" sections. Therefore, each string of springs would have only the end thirds of the string having the split top feature, the middle third lacking such feature.

Alternatively, in either product 10*e* shown in FIG. 15A or product 10*f* shown in FIG. 15B, all of the strings of springs may have the split top feature. However, the strings of springs of one or more sections or regions may lack ventilation openings, while the strings of springs of the other sections or regions may have ventilation openings. For example, the strings of springs of the middle zone 98 of the product 10*f* shown in FIG. 15B may have ventilation openings, but the strings of springs of the end zones 96 may lack ventilation openings.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A bedding or seating product comprising: a pocketed spring assembly having two border sections and an interior section between the border sections, each border section comprising a plurality of parallel longitudinally extending tall strings of springs joined together for edge support and the interior section comprising a plurality of parallel longitudinally extending alternating tall and short strings of springs, the tall strings of springs having a greater height than the short strings of springs, each of said strings of springs comprising a plurality of individually pocketed springs, each of said strings of springs comprising a piece of fabric joined along a longitudinal seam, a plurality of pockets being formed along a length of said string of springs by transverse seams joining first and second plies of said piece of fabric, wherein each of said transverse seams forming adjacent pockets of at least some of said strings of springs has an upper end located below an upper surface of said string so as to partially separate said adjacent pockets and enable an upper end portion of a respective spring of the individually pocketed springs to compress without substantially compressing the central convolutions of the respective spring, at least one spring being positioned in each said pocket, wherein at least one of the strings of springs has a plurality of ventilation openings; cushioning materials; and an upholstered covering encasing said pocketed spring assembly and cushioning materials.

2. A bedding or seating product comprising: a pocketed spring assembly having two border sections and an interior section between the border sections, each border section comprising a plurality of parallel longitudinally extending tall strings of springs joined together for edge support and the interior section comprising a plurality of parallel longitudinally extending alternating tall and short strings of springs, the tall strings of springs having a greater height than the short strings of springs, each of said strings of springs comprising a plurality of individually pocketed springs, each of said strings of springs comprising a piece of fabric joined along a longitudinal seam, a plurality of pockets being formed along a length of said string of springs by transverse seams joining first and second plies of said piece of fabric, wherein each of said transverse seams forming adjacent pockets of at least some of said strings of springs has an upper end located below an upper surface of said string so as to partially separate said adjacent pockets and enable an upper end portion of a respective spring of the individually pocketed springs to compress without substantially compressing the central convolutions of the respective spring, at least one spring being positioned in each said pocket, wherein at least one of the strings of springs has a plurality of ventilation openings.

3. The product of claim 2 wherein each of the springs has an upper end turn, a lower end turn and a plurality of convolutions between the end turns, within each of the tall strings of springs, the upper end turns of each of said springs being above the upper end of adjacent transverse seams when the spring is relaxed.

4. The product of claim 2 wherein each border section comprises a pair of strings of springs.

5. The product of claim 2 wherein each of the springs has a uniform diameter.

6. The product of claim 2 wherein the ventilation openings are located only in a portion of each pocket.

7. The product of claim 2 further comprising scrim sheets attached to some of the strings of springs.

8. The product of claim 2 further comprising at least one scrim sheet attached to some of the strings of springs.

9. A pocketed spring assembly for a bedding or seating product, said pocketed spring assembly comprising two border sections and an interior section between the border sections, each border section comprising a plurality of strings of springs, said interior section comprising a plurality of parallel strings of springs of different heights relative to each other, each of the strings of the border section having a height greater than some of the strings of the interior section, each of the strings being joined to an adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams between adjacent springs and forming adjacent pockets, wherein said transverse seams of at least some of said strings of springs have an upper end located below an upper surface of said string so as to partially separate said adjacent pockets and enable an upper end portion of a respective spring to compress without substantially compressing the central convolutions of the respective spring.

10. The spring assembly of claim 9 wherein at least a portion of at least one of the strings of springs has multiple ventilation openings.

11. The spring assembly of claim 9 wherein said strings of springs of said interior section alternate between springs of a first height and springs of a second height different than the first height.

12. The spring assembly of claim 11 wherein the first height is greater than the second height.

13. The spring assembly of claim 12 wherein said strings of springs of said border sections are of the first height.

14. The spring assembly of claim 13 wherein said longitudinal seam is a side seam.

15. A pocketed spring assembly for a bedding or seating product, said pocketed spring assembly comprising: two edge support sections and an interior section between the edge support sections, each edge support section comprising a plurality of parallel strings of springs, each of the parallel strings of springs of the edge support sections being of equal height, the interior section comprising a plurality of parallel strings of springs wherein at least some of the strings of springs of the interior section have a first height and at least some of the strings of springs of the interior section have a second height the first height being different than the second height, each of the strings of the edge support sections having a height greater than at least some of the strings of the interior section, each of the strings being joined to an adjacent string of springs, each of the strings comprising a plurality of interconnected pockets, each of the pockets containing at least one spring encased in fabric and having ventilation openings through the fabric, the fabric being joined to itself along a longitudinal seam and having first and second opposed plies of fabric on opposite sides of the springs, the fabric of said first and second plies being joined by transverse seams, wherein each of said transverse seams forming adjacent pockets of at least some of said strings of springs has an upper end located below an upper surface of said string so as to partially separate said adjacent pockets and enable an upper end portion of a respective spring to compress without substantially compressing central convolutions of the respective spring.

16. The spring assembly of claim 15 wherein an upper end turn of each of said springs is above the upper end of adjacent transverse seams when the spring is in a relaxed condition.

17. The spring assembly of claim 15 wherein said strings of springs extend longitudinally.

18. The spring assembly of claim 15 wherein said strings of springs extend transversely.

19. The spring assembly of claim 15 wherein the longitudinal seam of each of said strings of springs is located along one of the sides of the string of springs.

20. The spring assembly of claim 15 wherein the interior section of the spring assembly comprises alternating strings of different heights.

* * * * *